US010928767B2

(12) United States Patent
Someya et al.

(10) Patent No.: US 10,928,767 B2
(45) Date of Patent: Feb. 23, 2021

(54) HEATING DEVICE WITH A GUIDE HAVING CONVEX AND RECESS PORTIONS AND A CONNECTOR WITH A CONDUCTION TERMINAL

(71) Applicants: Yukimichi Someya, Saitama (JP); Tomoya Adachi, Kanagawa (JP); Yuusuke Furuichi, Kanagawa (JP)

(72) Inventors: Yukimichi Someya, Saitama (JP); Tomoya Adachi, Kanagawa (JP); Yuusuke Furuichi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/574,314

(22) Filed: Sep. 18, 2019

(65) Prior Publication Data

US 2020/0103814 A1 Apr. 2, 2020

(30) Foreign Application Priority Data

Sep. 28, 2018 (JP) ..... JP2018-184388

(51) Int. Cl.
*G03G 15/00* (2006.01)
*G03G 15/20* (2006.01)

(52) U.S. Cl.
CPC ..... *G03G 15/80* (2013.01); *G03G 15/2053* (2013.01); *G03G 15/2064* (2013.01)

(58) Field of Classification Search
CPC ..... G03G 15/2017; G03G 15/2053; G03G 15/2064; G03G 15/80
See application file for complete search history.

(56) References Cited

U.S. PATENT DOCUMENTS

2013/0302060 A1* 11/2013 Moriya ..... G03G 15/80 399/90
2013/0336672 A1* 12/2013 Mizuta ..... G03G 15/2053 399/75
2015/0277309 A1* 10/2015 Kuroda ..... G03G 15/2053 219/541

FOREIGN PATENT DOCUMENTS

JP 2014-081524 5/2014
JP 2015-191734 11/2015

OTHER PUBLICATIONS

U.S. Appl. No. 16/263,634, filed Jan. 31, 2019, Yuusuke Furuichi, et al.

(Continued)

*Primary Examiner* — Joseph S Wong
(74) *Attorney, Agent, or Firm* — Oblon, McClelland, Maier & Neustadt, L.L.P.

(57) ABSTRACT

A heating device includes a heater, a holder, a connector, and a guide pair. The heater includes an electrode through which power is conducted. The holder is configured to hold the heater. The connector includes a conduction terminal and an engagement portion. The conduction terminal is configured to contact the electrode. The engagement portion is configured to be engaged with the holder. The connector is attachable to the holder to engage the engagement portion with the holder and contact the conduction terminal with the electrode. The guide pair includes a convex portion and a recess. The convex portion is disposed in one of the holder and the connector. The recess is disposed in another one of the holder and the connector. The guide pair is configured to guide the connector in an attaching direction of the connector to attach the connector to the holder.

11 Claims, 13 Drawing Sheets

(56) References Cited

OTHER PUBLICATIONS

U.S. Appl. No. 16/269,616, filed Feb. 7, 2019, Tomoya Adachi, et al.
U.S. Appl. No. 16/285,733, filed Feb. 26, 2019, Yuusuke Furuichi, et al.
U.S. Appl. No. 16/352,390, filed Mar. 13, 2019, Tomoya Adachi, et al.
U.S. Appl. No. 16/391,959, filed Apr. 23, 2019, Takamasa Hase, et al.
U.S. Appl. No. 16/520,409, filed Jul. 24, 2019, Hiroshi Yosh Maga, et al.
U.S. Appl. No. 16/502,473, filed Jul. 3, 2019, Yuusuke Furuichi, et al.
U.S. Appl. No. 16/519,254, filed Jul. 23, 2019, Daisuke Inoue, et al.
U.S. Appl. No. 16/451,512, filed Jun. 25, 2019, Tomoya Adachi, et al.
U.S. Appl. No. 16/502,348, filed Jul. 3, 2019, Yuusuke Furuichi, et al.

* cited by examiner

HEATING DEVICE WITH A GUIDE HAVING CONVEX AND RECESS PORTIONS AND A CONNECTOR WITH A CONDUCTION TERMINAL

CROSS-REFERENCE TO RELATED APPLICATION

This patent application is based on and claims priority pursuant to 35 U.S.C. § 119(a) to Japanese Patent Application No. 2018-184388, filed on Sep. 28, 2018, in the Japan Patent Office, the entire disclosure of which is hereby incorporated by reference herein.

BACKGROUND

Technical Field

Embodiments of the present disclosure generally relate to a heating device, a fixing device, and an image forming apparatus. In particular, the embodiments of the present disclosure relate to a heating device, a fixing device for fixing a toner image on a recording medium with the heating device, and an image forming apparatus for forming an image on a recording medium with the fixing device.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly or indirectly via an intermediate transfer belt. Finally, a fixing device applies heat and pressure to the recording medium bearing the toner image to fix the toner image onto the recording medium. Thus, an image is formed on the recording medium.

Such image forming apparatuses are often provided with a heating device to heat a fixing rotator to a fixing temperature. The heating device includes, e.g., a heater and a connector. The heater is provided with an electrode that conducts an electric current. The connector is provided with a conduction terminal. When the conduction terminal contacts the electrode, the heater is energized to perform a heating operation.

SUMMARY

In one embodiment of the present disclosure, a novel heating device includes a heater, a holder, a connector, and a guide pair. The heater includes an electrode through which power is conducted. The holder is configured to hold the heater. The connector includes a conduction terminal and an engagement portion. The conduction terminal is configured to contact the electrode. The engagement portion is configured to be engaged with the holder. The connector is attachable to the holder to engage the engagement portion with the holder and contact the conduction terminal with the electrode. The guide pair includes a convex portion and a recess. The convex portion is disposed in one of the holder and the connector. The recess is disposed in another one of the holder and the connector. The guide pair is configured to guide the connector in an attaching direction of the connector to attach the connector to the holder.

Also described are novel fixing device incorporating the heating device and image forming apparatus incorporating the fixing device.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
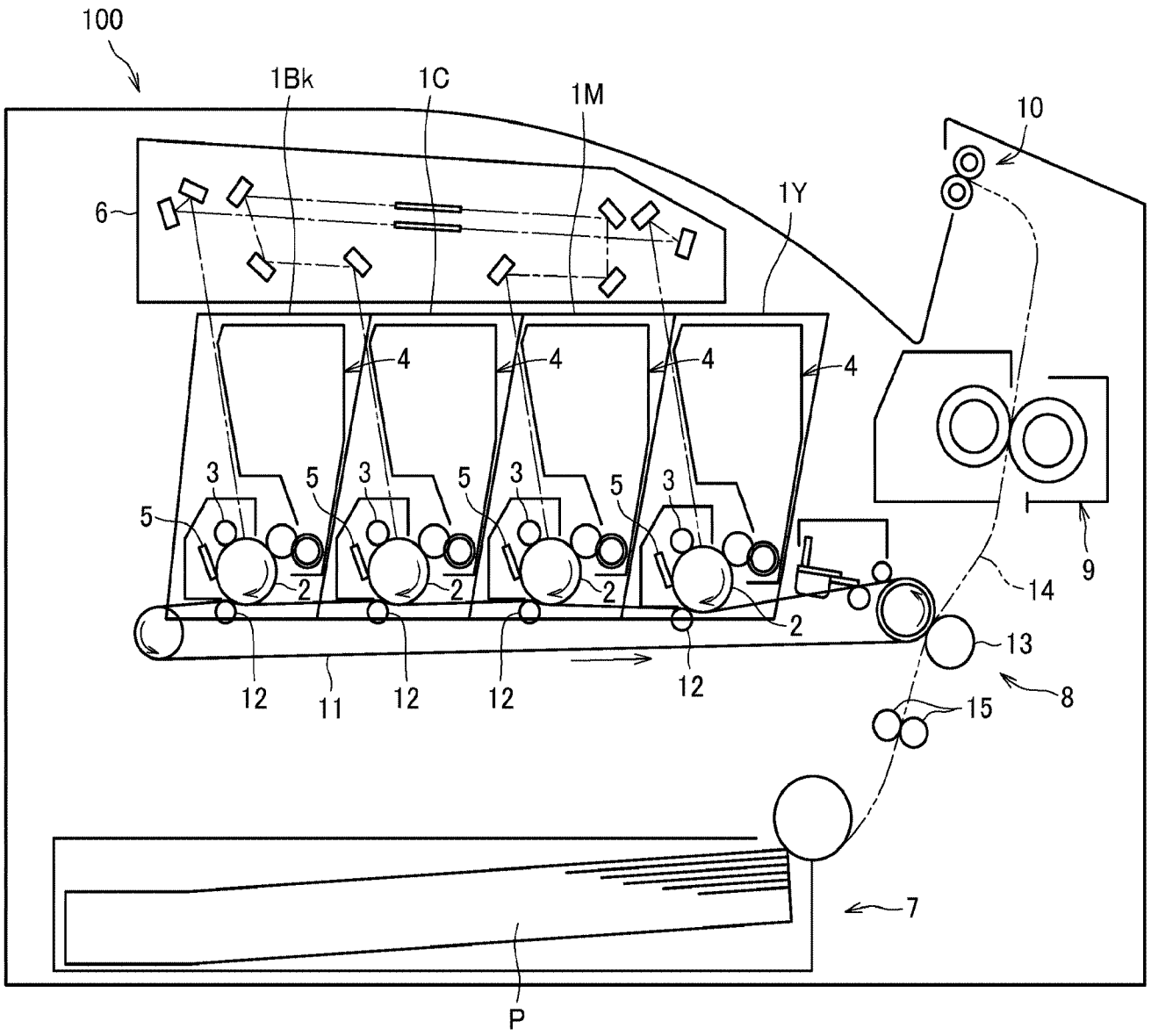
FIG. 1 is a schematic sectional view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

It is to be noted that, in the following description, suffixes Y, M, C, and Bk denote colors of yellow, magenta, cyan, and black, respectively. To simplify the description, these suffixes are omitted unless necessary.

Referring to the drawings, wherein like reference numerals designate identical or corresponding parts throughout the several views, embodiments of the present disclosure are described below.

Initially with reference to FIG. 1, a description is given of an image forming apparatus 100 according to an embodiment of the present disclosure.

FIG. 1 is a schematic sectional view of the image forming apparatus 100.

The image forming apparatus 100 illustrated in FIG. 1 is a color image forming apparatus that includes four image forming devices 1Y, 1M, 1C, and 1Bk. The four image forming devices 1Y, 1M, 1C, and 1Bk are removable from the image forming apparatus 100. The image forming devices 1Y, 1M, 1C, and 1Bk have identical configurations, except that the image forming devices 1Y, 1M, 1C, and 1Bk contain developers in different colors, namely, yellow (Y), magenta (M), cyan (C), and black (Bk) corresponding to color-separation components of a color image. Specifically, each of the image forming devices 1Y, 1M, 1C, and 1Bk includes a drum-shaped photoconductor 2, a charger 3, a developing device 4, and a cleaner 5. The photoconductor 2 serves as an image bearer that bears an electrostatic latent image and a resultant toner image. The charger 3 charges an outer circumferential surface of the photoconductor 2. The developing device 4 supplies toner to the electrostatic latent image formed on the outer circumferential surface of the photoconductor 2, rendering the electrostatic latent image visible as a toner image. In short, the developing device 4 forms a toner image on the photoconductor 2. The cleaner 5 cleans the outer circumferential surface of the photoconductor 2.

The image forming apparatus 100 further includes an exposure device 6, a sheet feeding device 7, a transfer device 8, a fixing device 9, and a sheet ejection device 10. The exposure device 6 exposes the outer circumferential surface of the photoconductor 2 to form an electrostatic latent image. The sheet feeding device 7 feeds or supplies a sheet P serving as a recording medium. The transfer device 8 transfers the toner image from the photoconductor 2 onto the sheet P. The fixing device 9 fixes the toner image onto the sheet P. The sheet ejection device 10 ejects the sheet P outside the image forming apparatus 100.

The transfer device 8 includes an intermediate transfer belt 11, four primary transfer rollers 12, and a secondary transfer roller 13. The intermediate transfer belt 11 is an endless belt serving as an intermediate transferor entrained around a plurality of rollers. Each of the four primary transfer rollers 12 serves as a primary transferor that transfers the toner image from the corresponding photoconductor 2 onto the intermediate transfer belt 11. The secondary transfer roller 13 serves as a secondary transferor that transfers the toner image from the intermediate transfer belt 11 onto the sheet P. The four primary transfer rollers 12 contact the respective photoconductors 2 via the intermediate transfer belt 11. In other words, each of the photoconductors 2 contacts the intermediate transfer belt 11, thereby forming an area of contact, herein referred to as a primary transfer nip, between each of the photoconductor 2 and the intermediate transfer belt 11. On the other hand, the secondary transfer roller 13 contacts, via the intermediate transfer belt 11, one of the plurality of rollers around which the intermediate transfer belt 11 is entrained, thereby forming an area of contact, herein referred to as a secondary transfer nip, between the secondary transfer roller 13 and the intermediate transfer belt 11.

Inside the image forming apparatus 100, the sheet P is conveyed from the sheet feeding device 7 along a sheet conveyance path 14 that is defined by internal components of the image forming apparatus 100. A timing roller pair 15 is provided between the sheet feeding device 7 and the secondary transfer nip (or the secondary transfer roller 13) on the sheet conveyance path 14.

To provide a fuller understanding of the embodiments of the present disclosure, a description is now given of a series of image forming operations of the image forming apparatus 100 with continued reference to FIG. 1.

In response to an instruction to start printing or forming an image, each of the image forming devices 1Y, 1M, 1C, and 1Bk causes the photoconductor 2 to rotate clockwise in FIG. 1 and the charger 3 to charge the surface of the photoconductor 2 to a uniform high potential. According to image information of a document read by a document reading device or print information instructed to print from a terminal, the exposure device 6 exposes the surface of each of the photoconductors 2 to decrease the electrostatic potential at an exposed portion, thereby forming an electrostatic latent image on the surface of each of the photoconductors 2. The developing device 4 supplies toner to the electrostatic latent image, rendering the electrostatic latent image visible as a toner image. Thus, the developing device 4 forms a toner image on the photoconductor 2.

The toner image thus formed on the photoconductor 2 reaches the primary transfer nip (or the position of the primary transfer roller 12) as the photoconductor 2 rotates. At the primary transfer nip, the toner image is transferred onto the intermediate transfer belt 11 that is rotated counterclockwise in FIG. 1. Specifically, the toner images are sequentially transferred from the respective photoconductors 2 onto the intermediate transfer belt 11 such that the toner images are superimposed one atop another, as a composite full-color toner image on the intermediate transfer belt 11. The full-color toner image on the intermediate transfer belt 11 is conveyed to the secondary transfer nip (or the position of the secondary transfer roller 13) as the intermediate transfer belt 11 rotates. At the secondary transfer nip, the full-color toner image is transferred onto the sheet P, which is supplied and conveyed from the sheet feeding device 7. Specifically, the sheet P supplied from the sheet feeding device 7 is temporarily stopped by the timing roller pair 15. The timing roller pair 15 then sends out the sheet P to the secondary transfer nip such that the sheet P meets the full-color toner image on the intermediate transfer belt 11 at the secondary transfer nip. Thus, the full-color toner image is transferred onto the sheet P. In other words, the sheet P bears the full-color toner image. The cleaner 5 removes residual toner from the photoconductor 2. The residual toner herein refers to toner that has failed to be transferred onto the photoconductor 2 and therefore remaining on the surface of the photoconductor 2.

The sheet P bearing the full-color toner image is conveyed to the fixing device 9, which fixes the full-color toner image onto the sheet P. The sheet ejection device 10 then ejects the sheet P outside the image forming apparatus 100. Thus, a series of image forming operations is completed.

Figure 2:
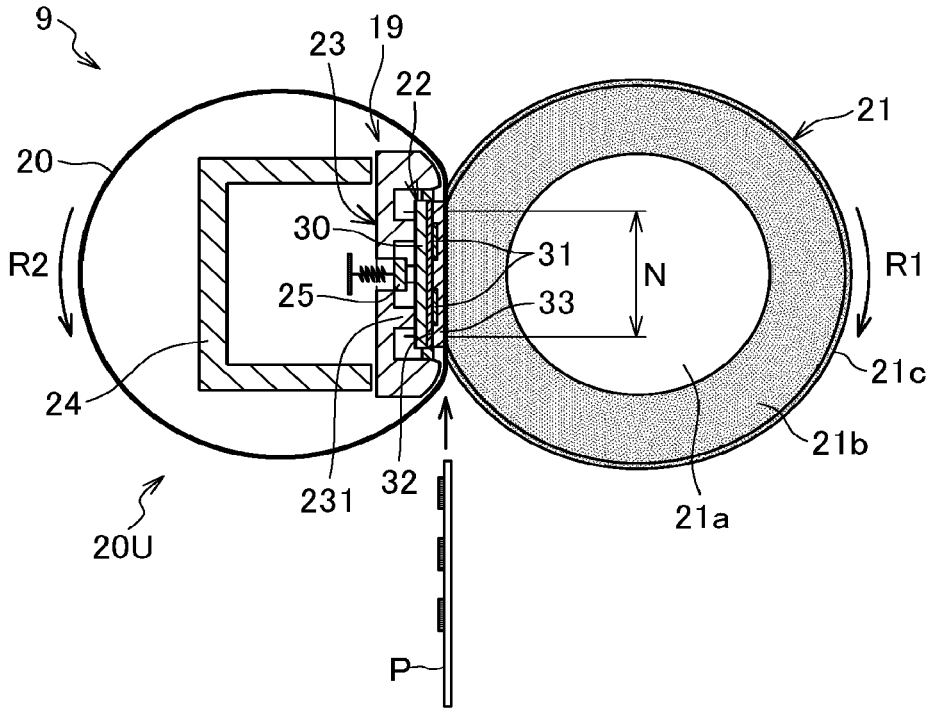
FIG. 2 is a schematic sectional view of a fixing device incorporated in the image forming apparatus of FIG. 1.

Referring now to FIG. 2, a description is given of a configuration of the fixing device 9 incorporated in the image forming apparatus 100 described above.

FIG. 2 is a schematic sectional view of the fixing device 9.

As illustrated in FIG. 2, the fixing device 9 according to the present embodiment includes a heating device 19, a fixing belt 20, and a pressure roller 21. The fixing belt 20 and the heating device 19 disposed inside a loop formed by the fixing belt 20 constitute a belt unit 20U that is detachably coupled to the pressure roller 21.

Specifically, the heating device 19 heats the fixing belt 20. The fixing belt 20 is an endless belt serving as a fixing rotator. The pressure roller 21 contacts an outer circumferential surface of the fixing belt 20 to form an area of contact, herein referred to as a fixing nip N, between the fixing belt 20 and the pressure roller 21. Since the pressure roller 21 is disposed opposite the fixing belt 20, the pressure roller 21 serves as an opposed rotator. The heating device 19 includes, e.g., a planar heater 22, a heater holder 23, a stay 24, and a thermistor 25. The heater holder 23 holds the heater 22. The stay 24 serves as a support that supports the heater holder 23. The thermistor 25 serves as a temperature detector.

The fixing belt 20 is constructed of a cylindrical base layer and a release layer. The base layer, made of polyimide (PI), has an outer diameter of 25 mm and a thickness in a range of from 40 μm to 120 μm, for example. The release layer, serving as an outermost layer of the fixing belt 20, has a thickness in a range of from 5 μm to 50 μm and is made of fluoroplastic such as tetrafluoroethylene-perfluoroalkylvinylether copolymer (PFA) and polytetrafluoroethylene (PTFE), to enhance durability of the fixing belt 20 and facilitate separation of toner, which is contained in a toner image on a sheet P, from the fixing belt 20. An elastic layer made of, e.g., rubber having a thickness in a range of from 50 μm to 500 μm may be provided between the base layer and the release layer. The base layer of the fixing belt 20 is not limited to polyimide. Alternatively, the base layer of the fixing belt 20 may be made of heat resistant resin, such as polyether ether ketone (PEEK), or metal, such as nickel (Ni) or stainless steel (or steel use stainless (SUS)). An inner circumferential surface of the fixing belt 20 may be coated with polyimide, PTFE, or the like as a slide layer.

The pressure roller 21 has an outer diameter of 25 mm, for example. The pressure roller 21 is constructed of a core 21*a*, an elastic layer 21*b*, and a release layer 21*c*. The core 21*a* is a solid core made of iron. The elastic layer 21*b* rests on the surface of the core 21*a*. The release layer 21*c* rests on an outer surface of the elastic layer 21*b*. The elastic layer 21*b* is made of silicone rubber and has a thickness of 3.5 mm, for example. The release layer 21*c* resting on the elastic layer 21*b* is preferably a fluoroplastic layer having a thickness of about 40 μm, for example, to facilitate separation of a foreign substance (e.g., paper dust and toner) from the pressure roller 21.

The heater 22 is provided longitudinally along a width direction of the fixing belt 20. In other words, a longitudinal direction of the heater 22 is parallel to the width direction of the fixing belt 20. The heater 22 includes, e.g., a plate-like base 30, a first insulation layer 32 provided on the base 30, a resistive heat generator 31 disposed on the first insulation layer 32, and a second insulation layer 33 that covers the resistive heat generator 31. In other words, the heater 22 is constructed of the base 30, the first insulation layer 32, the resistive heat generator 31, and the second insulation layer 33 in this order toward the fixing belt 20 (or the nip N). Heat generated from the resistive heat generator 31 is transmitted to the fixing belt 20 via the second insulation layer 33. In the present embodiment, the first insulation layer 32 is provided on a surface of the base 30 facing the fixing belt 20 or the fixing nip N (hereinafter referred to as a fixing-belt-side face of the base 30). On the other hand, no insulation layer is provided on a surface of the base 30 opposite the fixing belt 20, that is, a surface of the base 30 facing the heater holder 23 (hereinafter referred to as a heater-holder-side face of the base 30). Alternatively, an insulation layer may be provided on the heater-holder-side face of the base 30. When insulation layers having substantially the same thickness are provided on both of the fixing-belt-side face and the heater-holder-side face of the base 30, the insulation layers prevent the warp due to the thermal expansion difference generated between the base 30 and the insulation layers.

The heater holder 23 and the stay 24 are disposed opposite the inner circumferential surface of the fixing belt 20. The stay 24 is made of a metal channel material. Opposed end portions of the stay 24 in a longitudinal direction of the stay 24 are supported by opposed side plates of the fixing device 9. The stay 24 supports the heater holder 23 and the heater 22 held by the heater holder 23. With such a configuration, the heater 22 reliably receives a pressing force from the pressure roller 21 that is pressed against the fixing belt 20. Accordingly, the fixing nip N is stably formed between the fixing belt 20 and the pressure roller 21.

The heater holder 23 is susceptible to a temperature increase or overheating as the heater holder 23 receives heat from the heater 22. To address such a situation, the heater holder 23 is preferably made of a heat-resistant material. For example, the heater holder 23 may be made of a heat-resistant resin having a low thermal conductivity such as liquid crystal polymer (LCP). The heater holder 23 made of LCP reduces heat transfer from the heater 22 to the heater holder 23, allowing the heater 22 to efficiently heat the fixing belt 20. As illustrated in FIG. 2, the heater holder 23 includes a projecting portion 231 via which the heater holder 23 contacts the heater 22. The projecting portion 231 reduces a contact area between the heater 22 and the heater holder 23. That is, the projecting portion 231 reduces a heat amount conducted from the heater 22 to the heater holder 23.

The thermistor 25 detects the temperature of the heater 22. Based on the temperature detected by the thermistor 25, a controller controls power supplied to the heater 22 to adjust a heat amount of the fixing belt 20. Thus, the controller controls the temperature of the fixing belt 20 to a desired fixing temperature. The controller, serving as a heat controller, is a microcomputer including a central processing unit (CPU), a read-only memory (ROM), a random-access memory (RAM), and an input-output (I/O) interface. When a sheet P is conveyed through the fixing nip N, for example, the controller controls the temperature of the fixing belt 20 to the desired temperature with an appropriate input of additional power in consideration of the heat removed by the sheet P conveyed through the fixing nip N, in addition to the temperature detected by the thermistor 25.

The pressure roller 21 is pressed against the fixing belt 20 by a biasing member such as a spring. Accordingly, the pressure roller 21 is pressed against the heater 22 via the fixing belt 20, thus forming the fixing nip N between the fixing belt 20 and the pressure roller 21. Relatedly, a driver drives and rotates the pressure roller 21. As the pressure roller 21 rotates in a direction R1 in FIG. 2, the fixing belt 20 rotates in a direction R2 in FIG. 2.

When the series of printing operations starts, the pressure roller 21 is rotated. The rotation of the pressure roller 21 rotates the fixing belt 20. Meanwhile, the power is supplied to the heater 22 to heat the fixing belt 20. As illustrated in FIG. 2, a sheet P bearing an unfixed toner image is conveyed through the fixing nip N between the pressure roller 21 and the fixing belt 20 that reaches a given target temperature (i.e., fixing temperature). At the fixing nip N, the unfixed toner image is fixed onto the sheet P under heat and pressure.

Figure 28:
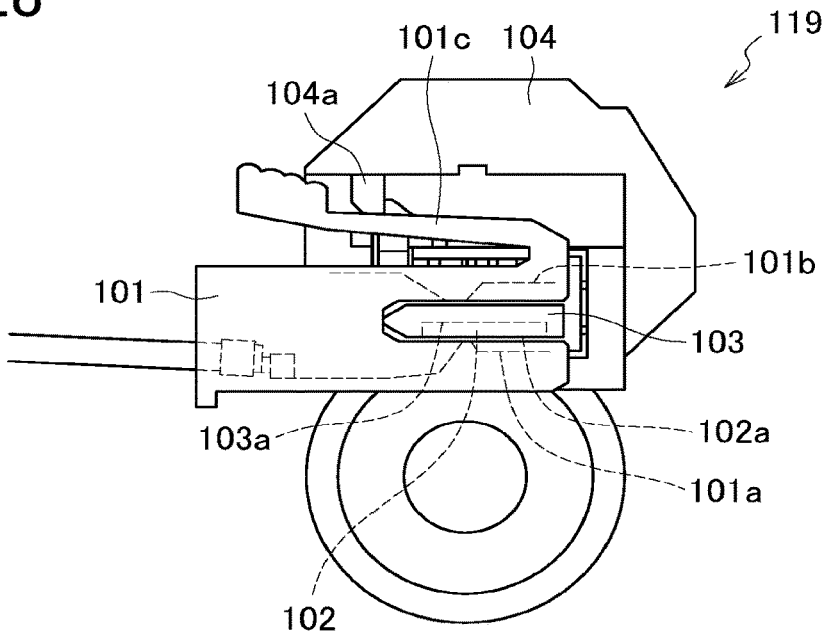
FIG. 28 is a schematic view of a comparative heating device.

Referring now to FIG. 28, a description is given of a comparative heating device 119.

FIG. 28 is a schematic view of the comparative heating device 119.

As illustrated in FIG. 28, the comparative heating device 119 includes a U-shaped connector 101, a ceramic heater 102, and a heater holder 103. The ceramic heater 102 is fit in a groove 103*a* of the heater holder 103. When the U-shaped connector 101 is moved to the right in FIG. 28 and attached to the heater holder 103, a spring 101*b* of the connector 101 presses the heater holder 103 downward in FIG. 28. Accordingly, a conduction terminal 101*a* of the connector 101 and an electrode 102*a* of the ceramic heater 102 contact each other. Thus, the ceramic heater 102 is energized. Meanwhile, the connector 101 locks a lock portion 101*c* to a joint 104*a* of a fixing flange 104.

When the connector 101 is deviated from an attaching direction or a given direction in which the connector 101 is attached to the heater holder 103, the connector 101 may be unsmoothly attached to the heater holder 103. As a consequence, the conduction terminal 101*a* and the electrode 102*a* may be improperly connected to each other, resulting in an energizing failure in the ceramic heater 102. In addition, while the connector 101 is engaged with the fixing flange 104, the backlash of the connector 101 against the heater holder 103 is likely to occur. Vibration or the like may separate the conduction terminal 101*a* from and the electrode 102*a* during operation of the device, resulting in the energizing failure.

To address such a situation, the embodiments of the present disclosure facilitate attachment of a connector to a heater holder while restraining the backlash of the connector against the heater holder after the connector is attached to the heater holder.

Now, a description is given of a configuration of a power supply portion for supplying power to the heater 22.

Figure 3:
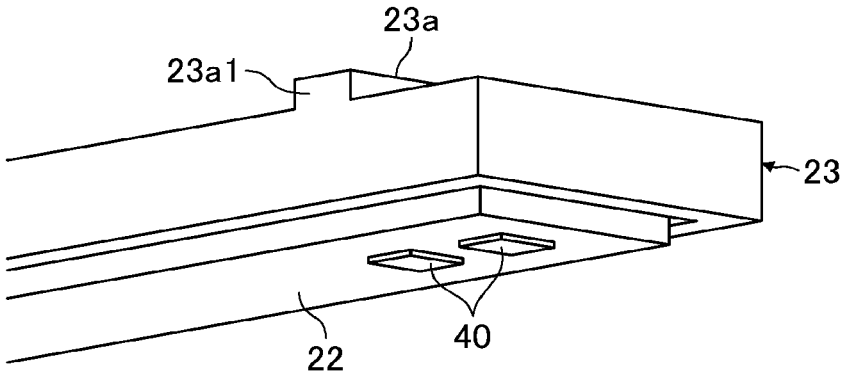
FIG. 3 is a perspective view of an end portion of a heater in a longitudinal direction of the heater and an end portion of a heater holder in a longitudinal direction of the heater holder according to a first embodiment of the present disclosure.

Initially with reference to FIG. 3, a description is given of relative positions and configurations of the heater 22 and the heater holder 23.

FIG. 3 is a perspective view of an end portion or an end side of the heater 22 (herein referred to as a first end side of the heater 22) in the longitudinal direction of the heater 22 and an end portion or an end side of the heater holder 23 (herein referred to as a first end side of the heater holder 23) in the longitudinal direction of the heater holder 23.

As illustrated in FIG. 3, the heater holder 23 is disposed longitudinally across a width of the heater 22. In other words, a longitudinal direction of the heater holder 23 is parallel to the longitudinal direction of the heater 22. The heater holder 23 holds the heater 22 across opposed end portions of the heater 22 in the longitudinal direction of the heater 22. First end portions of the heater 22 and the heater holder 23 illustrated in FIG. 3 are disposed outside an end portion of the fixing belt 20 of FIG. 2 in the width direction of the fixing belt 20. Note that the longitudinal direction of the heater 22 and the heater holder 23 is parallel to the width direction of the fixing belt 20 and therefore may be simply referred to as a width direction.

The first end side of the heater 22 is provided with two electrodes 40 on a surface opposite the surface held by the heater holder 23. In the present embodiment, the two electrodes 40 are disposed in the longitudinal direction of the heater 22. The heater holder 23 includes a convex portion 23*a* on a surface opposite the surface facing the heater 22. The convex portion 23*a* extends in a short direction of the heater holder 23, that is, the vertical direction in FIG. 2.

A connector 50 (illustrated in FIG. 4) is attached to the first end side of the heater 22 illustrated in FIG. 3.

Figure 4:
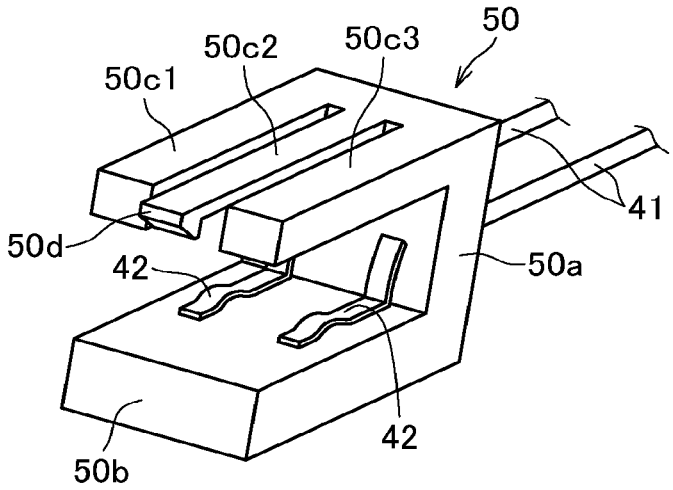
FIG. 4 is a perspective view of a connector according to the first embodiment of the present disclosure.

Referring now to FIG. 4, a description is given of a configuration of the connector 50.

FIG. 4 is a perspective view of the connector 50.

As illustrated in FIG. 4, the connector 50 is substantially U-shaped. Specifically, the connector 50 has a U-shape with right-angled bent portions. The connector 50 includes a vertical portion 50*a*, a horizontal portion 50*b*, and three horizontal portions 50*c*1, 50*c*2, and 50*c*3. The horizontal portion 50*b* extends in the horizontal direction from a first end portion of the vertical portion 50*a*. The three horizontal portions 50*c*, 50*c*2 and 50*c*3 extend in parallel in the horizontal direction from a second end portion of the vertical portion 50*a*.

Two power-supply harnesses 41 extend from a back side of the vertical portion 50*a* in FIG. 4. Two conduction terminals 42 are disposed on a surface of the horizontal portion 50*b* facing the horizontal portions 50*c*1, 50*c*2, and 50*c*3. The conduction terminals 42 are electrically connected to the harnesses 41 extending from the back side of the vertical portion 50*a* in FIG. 4.

An engagement claw 50*d*, serving as an engagement portion, is disposed at a distal end portion of the horizontal portion 50*c*2, which is a center horizontal portion of the three horizontal portions 50*c*1, 50*c*2, and 50*c*3. The distal end of the horizontal portion 50*c*2 at which the engagement claw 50*d* is disposed is a free end.

The horizontal portions 50*c*1 and 50*c*3 are respectively disposed opposite the two electrodes 40 in a direction in which the two electrodes 40 are arranged side by side. The horizontal portion 50*c*2 and the engagement claw 50*d* are disposed in the middle of the two conduction terminals 42 in a direction in which the two conduction terminals 42 are arranged side by side. In other words, when the connector 50 is attached to the heater holder 23 as described later, the horizontal portions 50*c*1 and 50*c*3 are respectively disposed opposite two contact positions (illustrated in FIG. 7) between the two electrodes 40 and the two conduction terminals 42 in the direction in which the two electrodes 40 are arranged side by side. Meanwhile, the horizontal portion 50*c*2 and the engagement claw 50*d* are disposed in the middle of the two contact positions between the two electrodes 40 and the two conduction terminals 42. Note that, at each of the two contact positions, the electrode 40 and the conduction terminal 42 contact each other.

Figure 5:
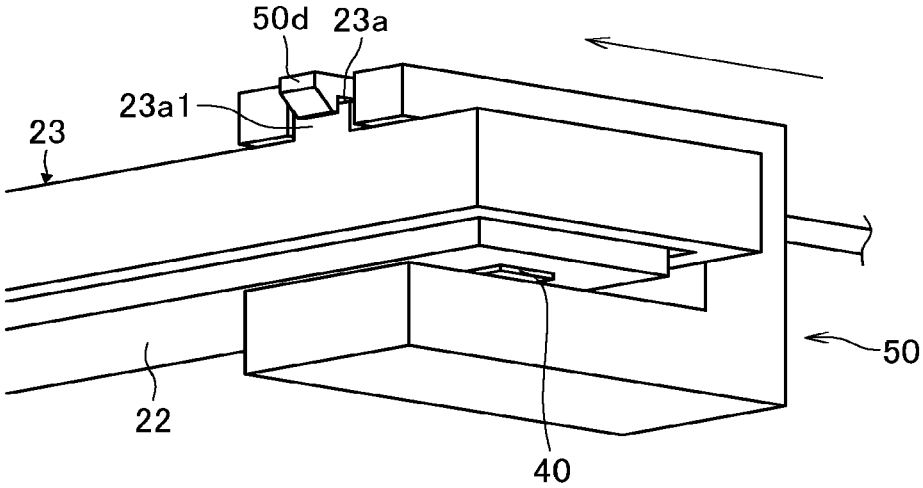
FIG. 5 is a perspective view of the connector attached to the heater holder.
Figure 6A:
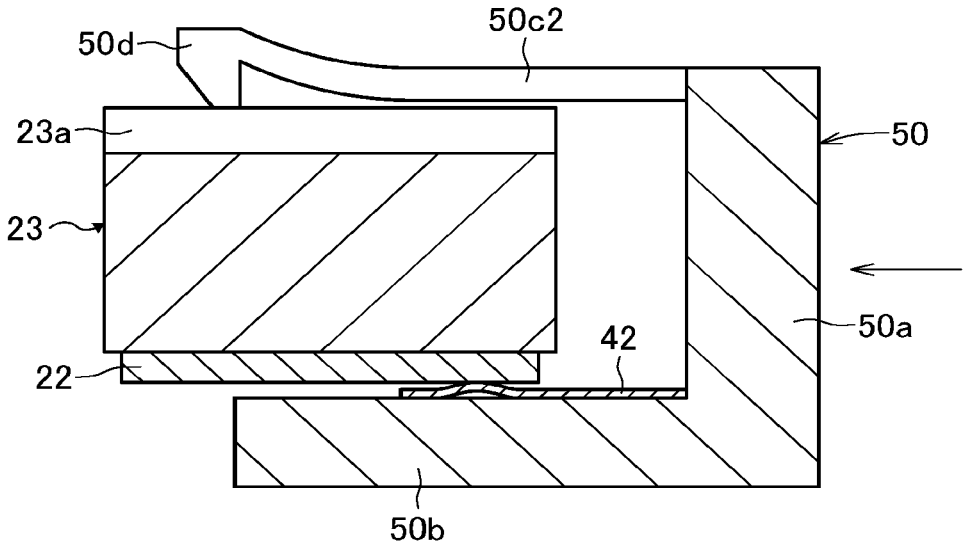
FIG. 6A is a cross-sectional view of the connector in the middle of attachment to the heater holder.
Figure 6B:
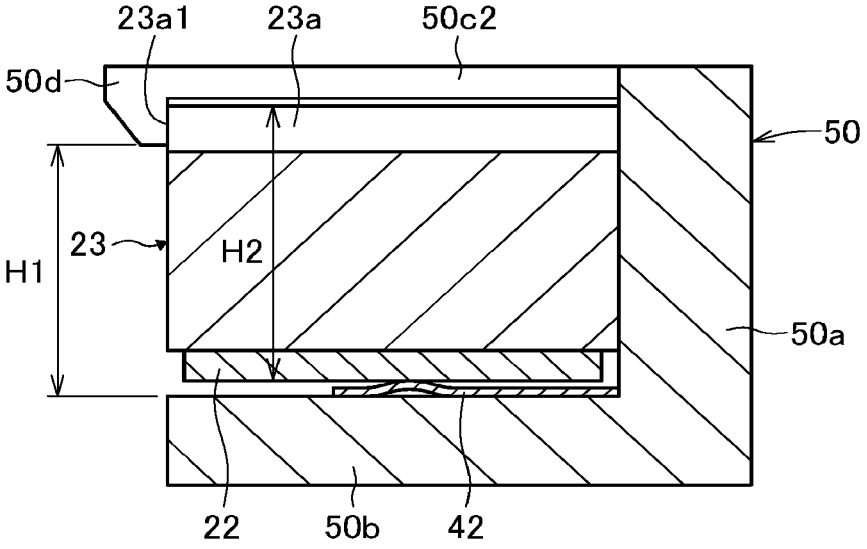
FIG. 6B is a cross-sectional view of the connector completely attached to the heater holder.

Referring now to FIGS. 5 to 6B, a description is given of an engagement of the connector 50 and the heater holder 23 that holds the heater 22.

FIG. 5 is a perspective view of the connector 50 attached to the heater holder 23. FIG. 6A is a cross-sectional view of the connector 50 in the middle of attachment to the heater holder 23. FIG. 6B is a cross-sectional view of the connector 50 completely attached to the heater holder 23.

As illustrated in FIG. 5, the connector 50 is moved in a direction indicated by arrow in FIG. 5 toward the heater 22 overlaid with the heater holder 23, to sandwich the heater 22 and the heater holder 23. Thus, the connector 50 is mounted on the heater 22 and the heater holder 23.

Specifically, as illustrated in FIG. 6A, the connector 50 is moved in an attaching direction of the connector 50, indicated by arrow in FIG. 6A such that the engagement claw 50*d* of the connector 50 moves on the convex portion 23*a* of the heater holder 23. At this time, the engagement claw 50*d* in contact with the convex portion 23*a* is elastically deformed upward in FIG. 6A. That is, as illustrated in FIG. 6B, a height H1 between a lower end of the engagement claw 50*d* and an upper face of the horizontal portion 50*b* is set smaller than a height H2 (i.e., thickness) of the heater 22 and the heater holder 23 including the convex portion 23*a*. The engagement claw 50*d* is elastically deformed upward in FIG. 6A by the difference of the height H1 and the height H2.

As the connector 50 is moved to an attachment position, the engagement claw 50*d* is moved to an end portion of the convex portion 23*a*. As illustrated in FIG. 6B, at the attachment position, the engagement claw 50*d* is released from the contact with the upper face of the convex portion 23*a*, thus returning to an original shape of the engagement claw 50*d*. That is, the engagement claw 50*d* is engaged with an engagement face 23*al* of the convex portion 23*a* at the attachment position. Thus, the connector 50 is mounted on the heater 22 and the heater holder 23.

Figure 7:
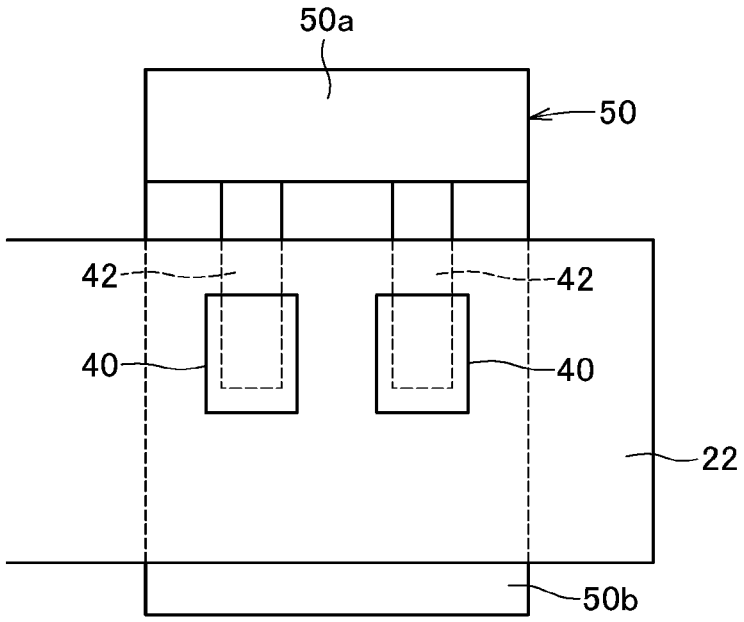
FIG. 7 is a schematic view of conduction terminals in contact with electrodes.

Referring now to FIG. 7, a description is given of relative positions of the conduction terminals 42 and the electrodes 40.

FIG. 7 is a schematic view of the conduction terminals 42 in contact with the electrodes 40, as a top view of FIGS. 6A and 6B.

As illustrated in FIG. 7, when the connector 50 is mounted on the heater 22 and the heater holder 23, the two conduction terminals 42 of the connector 50 contact the two electrodes 40 of the heater 22, respectively, to conduct power to the heater 22. The two conduction terminals 42 are disposed opposite the two electrodes 40, respectively, in the width direction, that is, the longitudinal direction of the heater 22 and the heater holder 23.

As illustrated in FIG. 6B, the engagement claw 50*d* engaged with the engagement face 23*al* prevents the disengagement of the connector 50 from the heater holder 23. In particular, the engagement claw 50*d* is directly engaged with the heater holder 23 to which the connector 50 is attached. Such a configuration effectively restrains the backlash of the connector 50 against the heater holder 23. Accordingly, even when vibration or the like applies an external force to the connector 50 during operation of the fixing device 9, a reliable contact state is maintained between the conduction terminals 42 and the electrodes 40.

Particularly in the present embodiment, the engagement claw 50*d* is disposed in the middle of the two conduction terminals 42 in the width direction. That is, the connector 50 is engaged with the heater holder 23 near the two contact positions between the two conduction terminals 42 and the two electrodes 40. As a consequence, even when an external force is applied to the connector 50 and the heater holder 23, the backlash is unlikely to occur between the conduction terminals 42 and the electrodes 40, thus reducing frictional forces generated between the conduction terminals 42 and the electrodes 40. Such reduction in friction reduces damage to the conduction terminals 42 and the electrodes 40 that may be caused by positional shifts and shaving of the conduction terminals 42 and the electrodes 40. Thus, a reliable contact state is maintained between the conduction terminals 42 and the electrodes 40, resulting in a reliable power conduction to the heater 22.

In the present embodiment, when the connector 50 is moved in the attaching direction toward the heater 22 and the heater holder 23, the convex portion 23*a* is interposed between the horizontal portion 50*c*1 and the horizontal portion 50*c*3. The convex portion 23*a* thus interposed guides the movement of the connector 50 toward the heater 22 and the heater holder 23 in the direction in which the horizontal portion 50*c*1 and the horizontal portion 50*c*3 extend, that is, the attaching direction of the connector 50. Accordingly, the connector 50 is easily mounted on the heater 22 and the heater holder 23. Thus, in the present embodiment, the convex portion 23*a* and a space (or recess) formed between the horizontal portion 50*c*1 and the horizontal portion 50*c*3 serves as a guide pair that guides the connector 50 in the attaching direction. Note that, the attaching direction of the connector 50 (or simply the attaching direction) refers to a direction to attach or mount the connector 50 to or on the heater 22 and the heater holder 23.

In addition, in the present embodiment, the engagement claw 50*d* is disposed at a position corresponding to a downstream end portion of the guide pair in the attaching direction, that is, a downstream end portion of the horizontal portion 50*c*2 in the attaching direction. With such a configuration, guiding the connector 50 in the attaching direction with the guide pair and engaging the engagement claw 50*d* of the connector 50 with the heater holder 23 can be performed as a series of operations. Accordingly, the connector 50 is easily and reliably engaged with the heater holder 23 and mounted on the heater holder 23 and the heater 22.

Referring now to FIGS. 8 to 24, a description is given of the heating device 19, in particular, the heater holder 23 and the connector 50, according to some other embodiments of the present disclosure. Note that, in the following description, different suffixes are occasionally given to the heater holder 23 and the connector 50 between the embodiments to clarify the difference therebetween. In the embodiments described below, the relative positions of the conduction terminals 42 and the horizontal portions 50*c*1, 50*c*2, and 50*c*3 of the connector 50 are substantially the same as the relative positions of the conduction terminals 42 and the horizontal portions 50*c*1, 50*c*2, and 50*c*3 of the connector 50 illustrated in FIG. 4.

Figure 8:
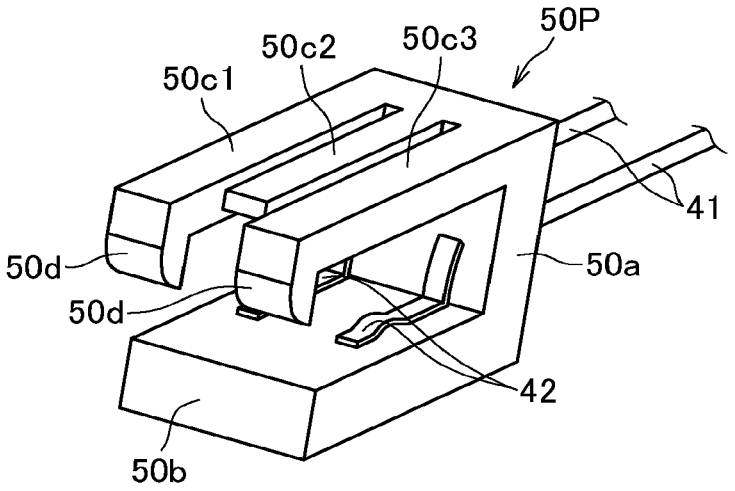
FIG. 8 is a perspective view of a connector according to a second embodiment of the present disclosure.

Initially with reference to FIG. 8, a description is given of a second embodiment of the present disclosure.

FIG. 8 is a perspective view of a connector 50P, as a part of the heating device 19, according to the second embodiment.

As illustrated in FIG. 8, the connector 50P includes the engagement claw 50*d* on the distal end of each of the horizontal portion 50*c*1 and the horizontal portion 50*c*3. By contrast, the horizontal portion 50*c*2 is not provided with an engagement claw.

The connector 50P of the present embodiment is attachable to the heater holder 23 and the heater 22 illustrated in FIG. 3, as in the first embodiment described above. In addition, like the first embodiment described above, the convex portion 23*a* is interposed in the space between the horizontal portion 50*c*1 and the horizontal portion 50*c*3 in the second embodiment.

When the connector 50P is attached, the engagement claw 50*d* disposed on each of the two horizontal portions 50*c*1 and 50*c*3 is engaged with a side face of the heater holder 23. Thus, in the present embodiment, the engagement claw 50*d* disposed on each side of the connector 50P is engaged with the heater holder 23. Such a configuration strengthens the engagement of the connector 50P with the heater holder 23, thereby restraining the backlash of the connector 50P against the heater holder 23. Thus, a further reliable contact state is maintained between the conduction terminals 42 and the electrodes 40.

Figure 9:
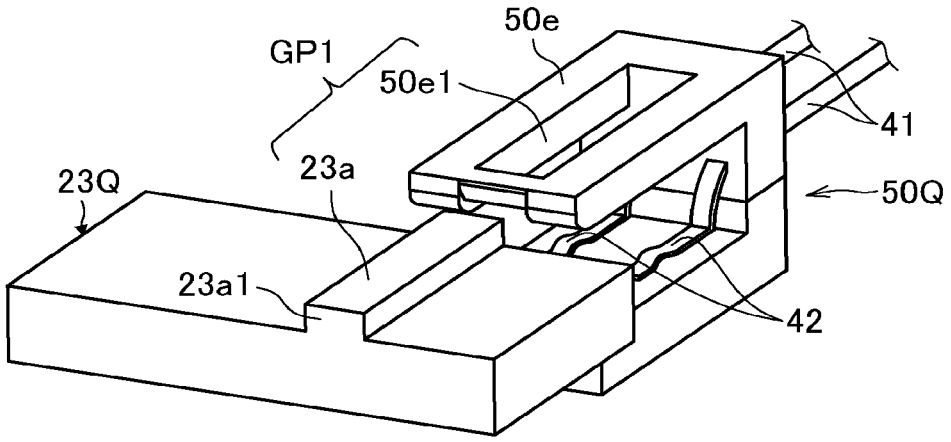
FIG. 9 is a top perspective view of a heater holder and a connector according to a third embodiment of the present disclosure.
Figure 10:
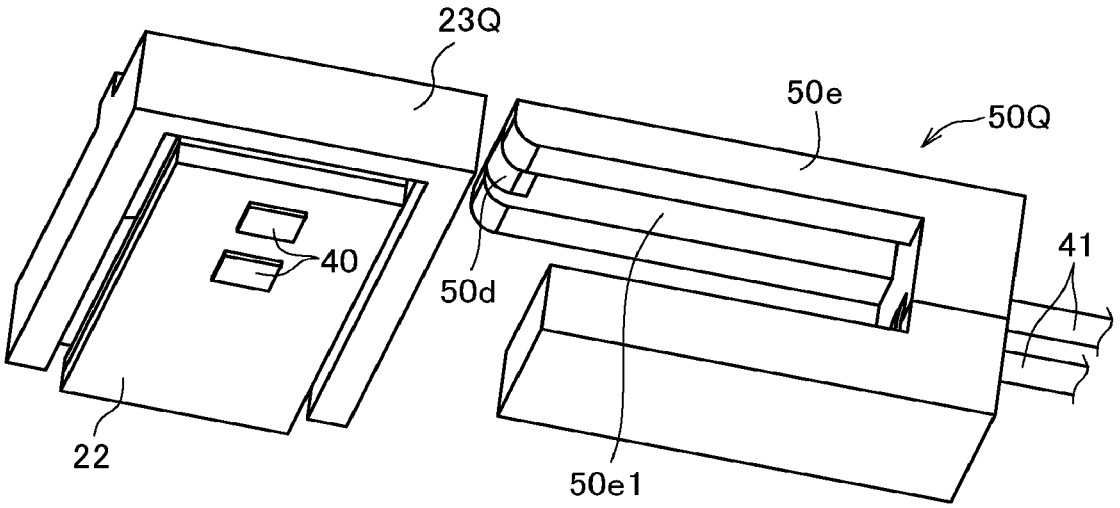
FIG. 10 is a bottom perspective view of the heater holder and the connector according to the third embodiment of the present disclosure.

Referring now to FIGS. 9 and 10, a description is given of a third embodiment of the present disclosure.

FIG. 9 is a top perspective view of a heater holder 23Q and a connector 50Q, as a part of the heating device 19, according to the third embodiment. FIG. 10 is a bottom perspective view of the heater holder 23Q and the connector 50Q according to the third embodiment.

In the present embodiment, a horizontal portion 50*e* is disposed on one end portion of the connector 50Q as illustrated in FIG. 9. The horizontal portion 50*e* has a through hole 50*e*1 serving as a recess at a center of the horizontal portion 50*e*. As illustrated in FIG. 10, the engagement claw 50*d* is disposed on an end side of the horizontal portion 50*e*. When the connector 50Q is attached to the heater holder 23Q, the engagement claw 50*d* is located at a center (or an average position) of the two contact positions between the two electrodes 40 and the two conduction terminals 42 in the width direction. In the present embodiment, the convex portion 23*a* and the through hole 50*e*1 serve as a guide pair GA1. In other words, the guide pair GA1 includes the convex portion 23*a* and the through hole 50*e*1. That is, while the connector 50Q is moved to be attached, a relative movement of the convex portion 23*a* within the through hole 50*e*1 guides the connector 50Q in the attaching direction. Then, the engagement claw 50*d* is engaged with the engagement face 23*a*1, thereby restricting the backlash of the connector 50Q.

Figure 11:
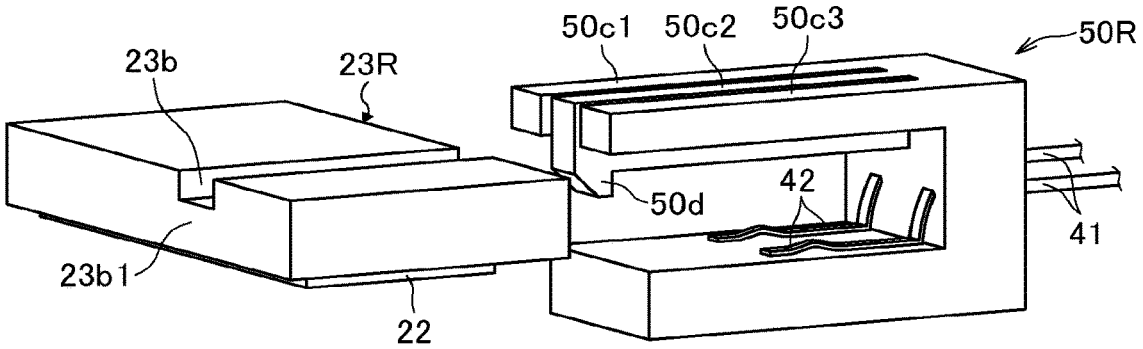
FIG. 11 is a perspective view of a heater holder and a connector according to a fourth embodiment of the present disclosure.
Figure 12:
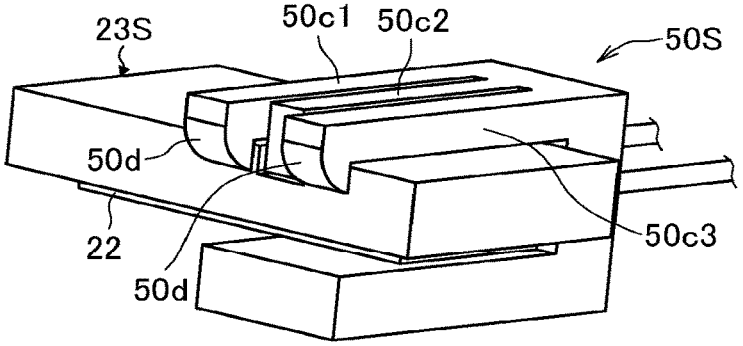
FIG. 12 is a perspective view of a heater holder and a connector according to a fifth embodiment of the present disclosure.

Referring now to FIGS. 11 and 12, a description is given of the heating device 19 according to fourth and fifth embodiments of the present disclosure. Unlike the embodiments described above, the heater holder 23 is provided with a recess (or groove) while the connector 50 is provided with a convex portion in the fourth and fifth embodiments. The recess and the convex portion serve as a guide pair.

Initially with reference to FIG. 11, a description is given of the fourth embodiment of the present disclosure.

FIG. 11 is a perspective view of a heater holder 23R and a connector 50R, as a part of the heating device 19, according to the fourth embodiment.

As illustrated in FIG. 11, in the fourth embodiment, the heater holder 23R is provided with a groove 23*b* extending in the attaching direction. The engagement claw 50*d* is disposed at the distal end portion of the horizontal portion 50*c*2 of the connector 50R. The groove 23*b* and the engagement claw 50*d* are located at the center (or average position) of the two contact positions between the two electrodes 40 and the two conduction terminals 42 in the width direction.

In the present embodiment, the horizontal portion 50*c*2 is thicker than the other horizontal portions 50*c*1 and 50*c*3 in the vertical direction in FIG. 11. A lower thick portion of the horizontal portion 50*c*2 and the groove 23*b* serve as a guide pair. That is, as the lower portion of the horizontal portion 50*c*2 moves in the groove 23*b*, the connector 50R is guided in the attaching direction in FIG. 11. When the connector 50R is attached to the heater holder 23R, the engagement claw 50*d* is engaged with a side face 23*b*1 of the heater holder 23R. Thus, like the other embodiments described above, the guide pair guides the attachment of the connector 50R in the present embodiment. In addition, the connector 50R is attached to the heater holder 23R to engage the engagement claw 50*d* with the heater holder 23R.

Referring now to FIG. 12, a description is given of the fifth embodiment of the present disclosure.

FIG. 12 is a perspective view of a heater holder 23S and a connector 50S, as a part of the heating device 19, according to the fifth embodiment.

Instead of the horizontal portion 50*c*2, each of the horizontal portions 50*c*1 and 50*c*3 is provided with the engagement claw 50*d* in the connector 50S of the present embodiment.

Figure 13:
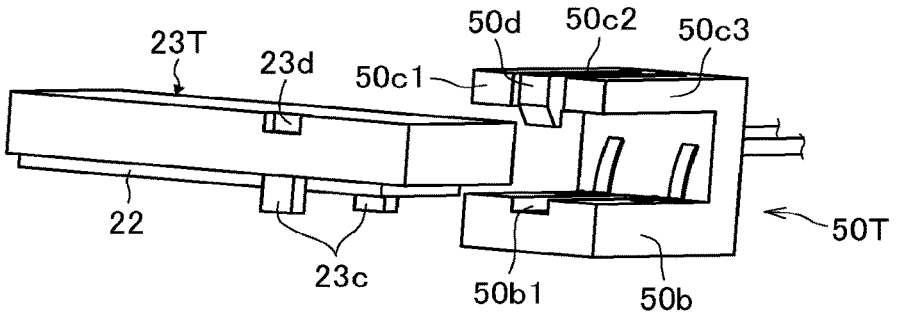
FIG. 13 is a perspective view of a heater holder and a connector according to a sixth embodiment of the present disclosure.
Figure 14:
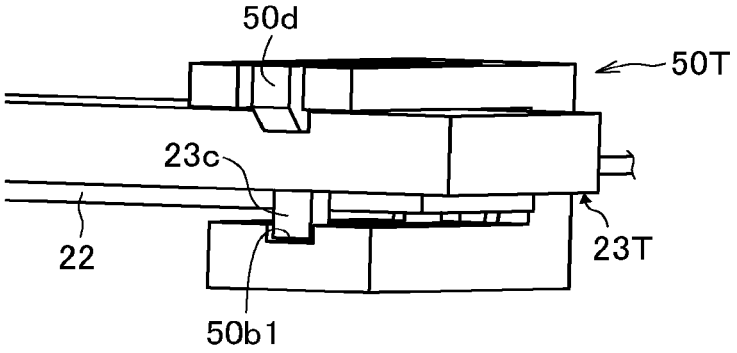
FIG. 14 is a perspective view of the heater holder and the connector coupled to each other according to the sixth embodiment of the present disclosure.

Referring now to FIGS. 13 and 14, a description is given of a sixth embodiment of the present disclosure.

FIG. 13 is a perspective view of a heater holder 23T and a connector 50T, as a part of the heating device 19, according to the sixth embodiment. FIG. 14 is a perspective view of the heater holder 23T and the connector 50T coupled to each other according to the sixth embodiment.

Unlike the embodiments described above, the heater holder 23T is provided with a guide extending toward the heater 22.

Specifically, as illustrated in FIG. 13 for example, the heater holder 23T includes two convex guides 23*c* extending toward the heater 22. The two convex guides 23*c* are respectively disposed on upstream and downstream end portions of the heater holder 23T in the attaching direction. At the downstream end portion of the heater holder 23T, an engagement recess 23*d* is provided above the convex guide 23*c* in FIG. 13.

On the other hand, the connector 50T is provided with a guide groove 50*b*1 extending in the attaching direction on the upper face of the horizontal portion 50*b*. The three horizontal portions 50*c*1, 50*c*2, and 50*c*3 are disposed above the horizontal portion 50*b* in FIG. 13. The engagement claw 50*d* is disposed at the distal end portion of the horizontal portion 50*c*2.

The two convex guides 23*c*, the engagement recess 23*d*, the guide groove 50*b*1, and the engagement claw 50*d* are located at the center (or average position) of the two contact positions between the two electrodes 40 and the two conduction terminals 42 in the width direction.

In the present embodiment, the two convex guides 23*c* and the guide groove 50*b*1 serve as a guide pair GA2. In other words, the guide pair GA2 includes the two convex guides 23*c* and the guide groove 50*b*1. As illustrated in FIG. 14, when the connector 50T is attached to the heater holder 23T, the engagement claw 50*d* is engaged with the engagement recess 23*d*.

Figure 15:
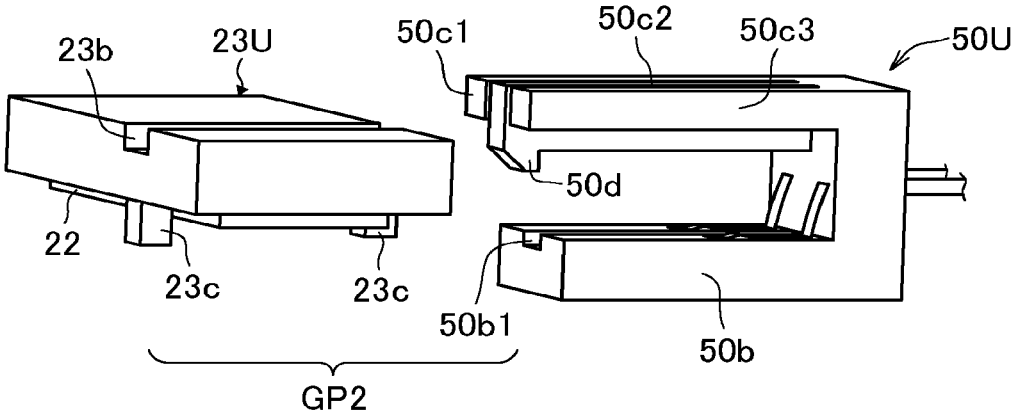
FIG. 15 is a perspective view of a heater holder and a connector according to a seventh embodiment of the present disclosure.
Figure 16:
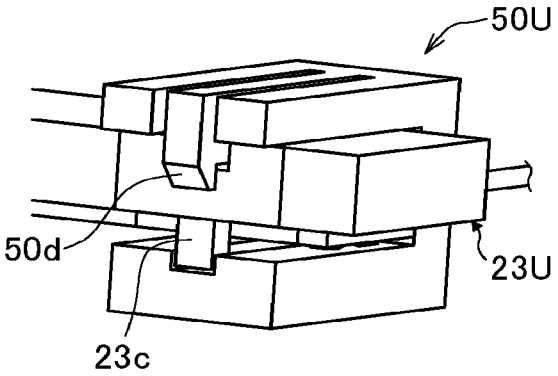
FIG. 16 is a perspective view of the heater holder and the connector coupled to each other according to the seventh embodiment of the present disclosure.

Referring now to FIGS. 15 and 16, a description is given of a seventh embodiment of the present disclosure.

FIG. 15 is a perspective view of a heater holder 23U and a connector 50U, as a part of the heating device 19, according to the seventh embodiment of the present disclosure. FIG. 16 is a perspective view of the heater holder 23U and the connector 50U coupled to each other according to the seventh embodiment.

Instead of the engagement recess 23*d*, the groove 23*b* is provided on an upper face of the heater holder 23U. In this case, the lower portion of the horizontal portion 50*c*2 of the connector 50U is guided in the groove 23*b* in FIG. 15. In the present embodiment, two guide pairs are provided on upper and lower sides, respectively, in FIGS. 15 and 16. The connector 50U is smoothly moved and attached to the heater holder 23U with the two guide pairs.

Figure 17:
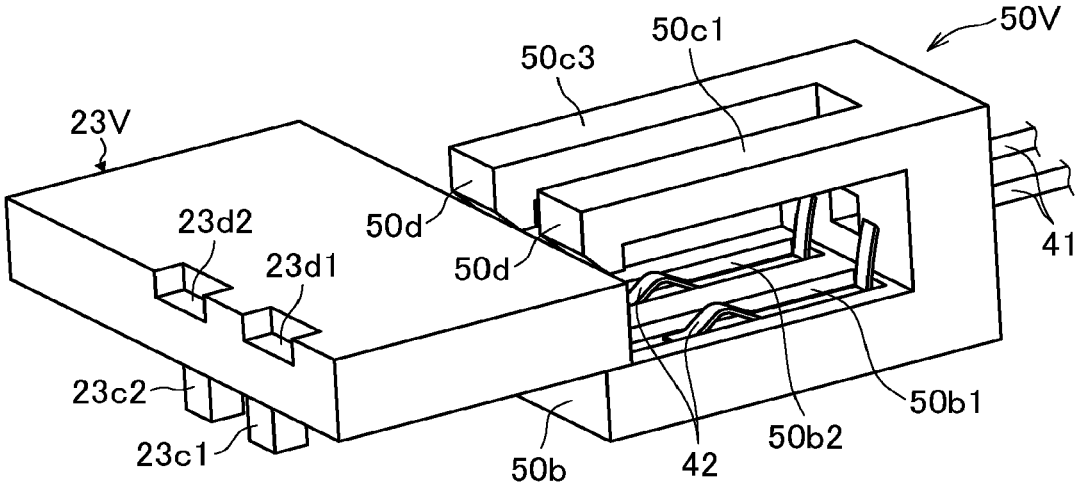
FIG. 17 is a perspective view of a heater holder and a connector according to an eighth embodiment of the present disclosure.

Referring now to FIG. 17, a description is given of an eighth embodiment of the present disclosure.

FIG. 17 is a perspective view of a heater holder 23V and a connector 50V, as a part of the heating device 19, according to the eighth embodiment.

The horizontal portion 50*b* of the connector 50V is provided with two guide grooves 50*b*1 and 50*b*2. The two conduction terminals 42 are disposed halfway in the attaching direction in the two guide grooves 50*b*1 and 50*b*2, respectively. The conduction terminals 42 are plate springs. A part of the conduction terminal 42 protrudes from each of the guide grooves 50*b*1 and 50*b*2. On the other hand, the heater holder 23V is provided with two convex guides 23*c*1 and 23*c*2 extending toward the heater 22. Note that two other convex guides 23*c*1 and 23*c*2 are disposed on an upstream side of the heater holder 23V in the attaching direction, at the same positions in the width direction as the positions of the two convex guides 23*c*1 and 23*c*2 on a downstream side of the heater holder 23V in the attaching direction.

In the present embodiment, the conduction terminals 42 respectively disposed in the middle of the guide grooves 50*b*1 and 50*b*2 reliably contact the electrodes 40 while the connector 50V is guided by the guide pairs and attached to the heater holder 23V.

In addition, in the present embodiment, each of the horizontal portions 50*c*1 and 50*c*3 of the connector 50V is provided with the engagement claw 50*d*. On the other hand, the heater holder 23V is provided with two engagement recesses 23*d*1 and 23*d*2. The engagement claws 50*d* are configured to be engaged with the engagement recesses 23*d*1 and 23*d*2, respectively. Each of the engagement claws 50*d* is disposed corresponding to the contact position between the electrode 40 and the conduction terminal 42.

Figure 18:
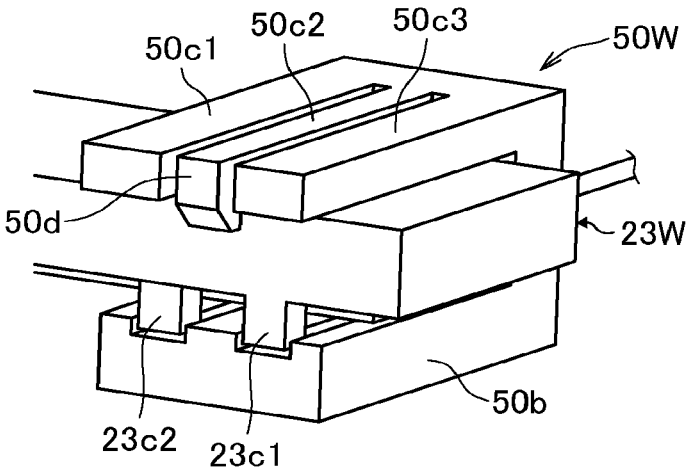
FIG. 18 is a perspective view of a heater holder and a connector according to a first example of a ninth embodiment of the present disclosure.
Figure 19:
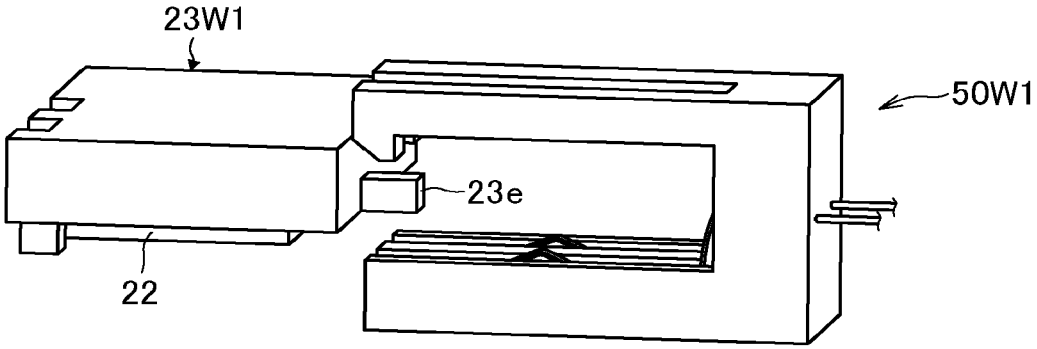
FIG. 19 is a side view of a heater holder and a connector according to a second example of the ninth embodiment of the present disclosure.
Figure 20:
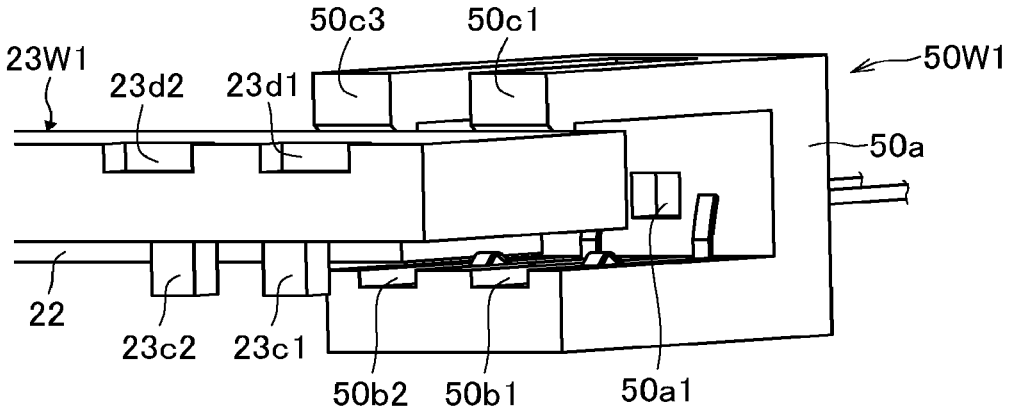
FIG. 20 is a perspective view of the heater holder and the connector according to the second example of the ninth embodiment of the present disclosure.

Referring now to FIGS. 18 to 20, a description is given of a ninth embodiment of the present disclosure.

FIG. 18 is a perspective view of a heater holder 23W and a connector 50W, as a part of the heating device 19, according to a first example of the ninth embodiment. FIG. 19 is a side view of a heater holder 23W1 and a connector 50W1, as a part of the heating device 19, according to a second example of the ninth embodiment. FIG. 20 is a perspective view of the heater holder 23W1 and the connector 50W1 according to the second example of the ninth embodiment.

FIG. 18 illustrates the first example in which the horizontal portion 50*c*2, located at the center of the horizontal portions 50*c*1, 50*c*2, and 50*c*3, is provided with the engagement claw 50*d*. The engagement claw 50*d* is engaged with an engagement recess or a side face of the heater holder 23W. Note that the engagement claw 50*d* is located at the center (or average position) of the two contact positions between the two electrodes 40 and the two conduction terminals 42 in the width direction.

FIGS. 19 and 20 illustrate the second example in which each of the horizontal portions 50*c*1 and 50*c*3 is provided with the engagement claw 50*d*.

As illustrated in FIG. 19, a convex fitting portion 23*e* is disposed on an upstream side of a heater holder 23W1 in the attaching direction. On the other hand, as illustrated in FIG. 20, the vertical portion 50*a* of a connector 50W1 is provided with a fitting recess 50*a*1. When the connector 50W1 is attached to the heater holder 23W1, the convex fitting portion 23*e* is fit into the fitting recess 50*al*, thereby enhancing the positional accuracy of the connector 50W1 relative to the heater holder 23W1.

Figure 21:
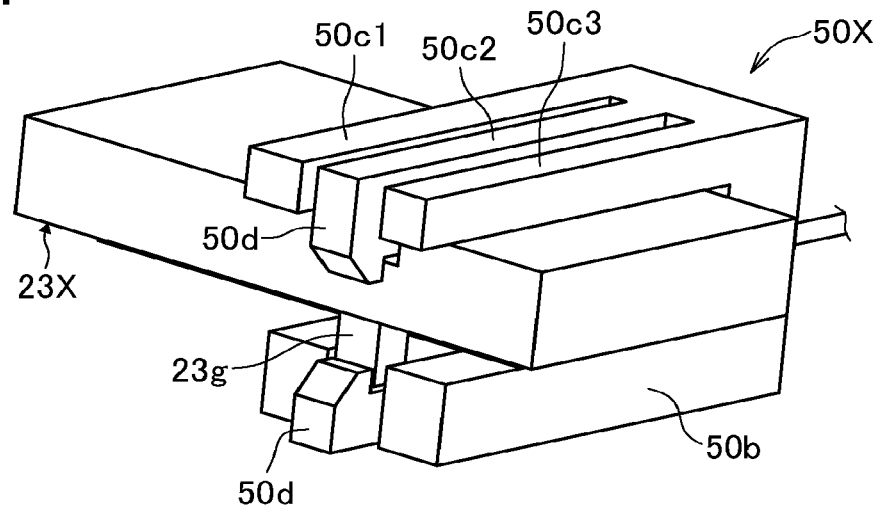
FIG. 21 is a perspective view of a heater holder and a connector according to a tenth embodiment of the present disclosure.

Referring now to FIG. 21, a description is given of a tenth embodiment of the present disclosure.

FIG. 21 is a perspective view of a heater holder 23X and a connector 50X, as a part of the heating device 19, according to the tenth embodiment.

In the connector 50X of the present embodiment, the horizontal portion 50*b* is provided with the engagement claw 50*d*. On the other hand, the heater holder 23X is provided with a convex portion 23*g*. When the connector 50X is attached to the heater holder 23X, the engagement claw 50*d* contacts and is engaged with the convex portion 23*g*. Thus, in the present embodiment, the engagement claw 50*d* is disposed on each of opposed sides of the connector 50X in a thickness direction of the heater holder 23X. Accordingly, the connector 50X is engaged with the heater holder 23X, while sandwiching the heater holder 23X, at two positions of the connector 50X in the vertical direction in FIG. 21, that is, the thickness direction of, e.g., the heater holder 23X.

Such a configuration restrains the backlash of the connector 50X against the heater holder 23X in the vertical direction in FIG. 21.

In the embodiments described above, the connector 50 is attached to heater holder 23 in the short direction of the heater holder 23. In other words, the attaching direction of the connector 50 is the short direction of the heater holder 23. Alternatively, as illustrated in FIGS. 22 and 23, the connector 50 may be attached to the heater holder 23 in the longitudinal direction of the heater holder 23 (i.e., width direction).

Figure 22:
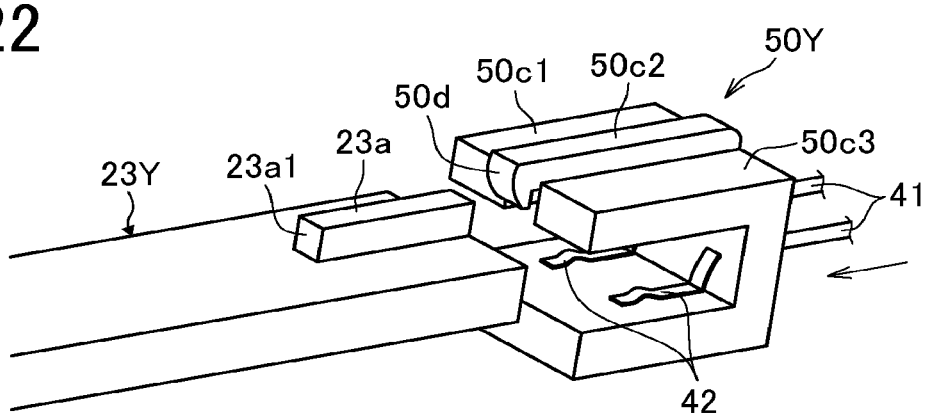
FIG. 22 is a perspective view of a heater holder and a connector according to an eleventh embodiment of the present disclosure.
Figure 23:
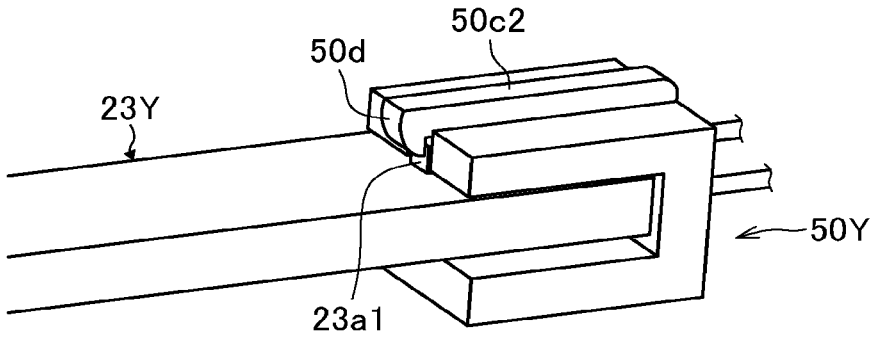
FIG. 23 is a perspective view of the heater holder and the connector coupled to each other according to the eleventh embodiment of the present disclosure.

Referring now to FIGS. 22 and 23, a description is given of an eleventh embodiment of the present disclosure.

FIG. 22 is a perspective view of a heater holder 23Y and a connector 50Y, as a part of the heating device 19, according to the eleventh embodiment. FIG. 23 is a perspective view of the heater holder 23Y and the connector 50Y coupled to each other according to the eleventh embodiment.

In the present embodiment, the convex portion 23*a* is disposed on a first end or first end side of the heater holder 23Y in a longitudinal direction of the heater holder 23Y, that is, the width direction. As illustrated in FIG. 22, the convex portion 23*a* extends in the width direction. The connector 50Y is moved in a direction indicated by arrow in FIG. 22, from the outside of the first end of the heater holder 23Y in the longitudinal direction of the heater holder 23Y (i.e., width direction) to a second end side of the heater holder 23Y in the longitudinal direction of the heater holder 23Y (i.e., width direction). Thus, the connector 50Y is attached to the heater holder 23Y. When the connector 50Y is moved and attached to the heater holder 23Y, the convex portion 23*a* is interposed between the horizontal portion 50*c*1 and the horizontal portion 50*c*3 of the connector 50Y. Such a configuration restricts the moving direction of the connector 50Y, thereby guiding the connector 50Y in the attaching direction. In addition, as illustrated in FIG. 23, the engagement claw 50*d* disposed on the distal end portion of the horizontal portion 50*c*2 is engaged with the engagement face 23*a*1 of the convex portion 23*a* after moving on the convex portion 23*a*. Note that, in the present embodiment, the two electrodes 40 are disposed in a short direction of the heater 22. The convex portion 23*a* and the engagement claw 50*d* are located at a center (or average position) of the two contact positions between the two electrodes 40 and the two conduction terminals 42 in a direction perpendicular to the width direction (i.e., short direction of heater 22).

Figure 24:
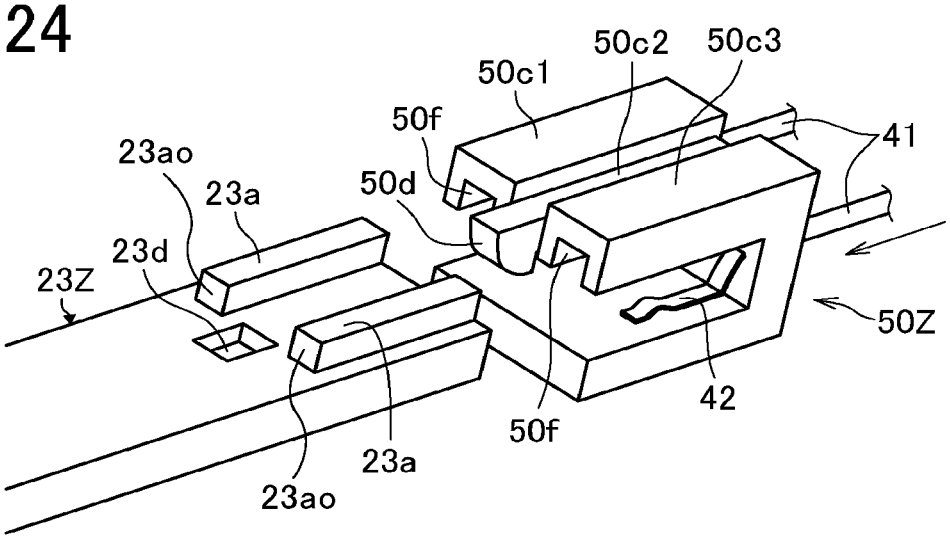
FIG. 24 is a perspective view of a heater holder and a connector according to a twelfth embodiment of the present disclosure.

Referring now to FIG. 24, a description is given of a twelfth embodiment of the present disclosure.

FIG. 24 is a perspective view of a heater holder 23Z and a connector 50Z, as a part of the heating device 19, according to the twelfth embodiment.

In the present embodiment, two convex portions 23*a* are disposed on a first end or first end side of the heater holder 23Z in a longitudinal direction of the heater holder 23Z, that is, the width direction. As illustrated in FIG. 24, the two convex portions 23*a* extend in the width direction. One engagement recess 23*d* is disposed beyond an end 23*ao* of each of the two convex portions 23*a* toward a second end side of the heater holder 23Z in the longitudinal direction of the heater holder 23Z (i.e., width direction), between the two convex portions 23*a*. As illustrated in FIG. 24, the end 23*ao* is an end of each of the two convex portions 23*a* in a longitudinal direction of the two convex portions 23*a* (i.e., width direction), on the second end side of the heater holder 23Z in the longitudinal direction of the heater holder 23Z (i.e., width direction). On the other hand, the engagement claw 50*d* is disposed at the distal end portion of the horizontal portion 50*c*2 of the connector 50Z. Each of the horizontal portions 50*c*1 and 50*c*3 has a substantially U-shaped cross section. Specifically, each of the horizontal portions 50*c*1 and 50*c*3 includes a guide recess 50*f* extending in the width direction. The engagement recess 23*d* and the engagement claw 50*d* are located at the center (or average position) of the two contact positions between the two electrodes 40 and the two conduction terminals 42 in the width direction.

In the present embodiment, the connector 50Z is guided in the attaching direction indicated by arrow in FIG. 24, which is a direction from the first end side of the heater holder 23Z in the longitudinal direction of the heater holder 23Z (i.e., width direction) to the second end side of the heater holder 23Z in the longitudinal direction of the heater holder 23Z (i.e., width direction), while the two convex portions 23*a* of the heater holder 23Z are fit in the guide recesses 50*f* of the horizontal portions 50*c*1 and 50*c*3, respectively. Thus, the connector 50Z is attached to the heater holder 23Z. In addition, when the connector 50Z is attached to the heater holder 23Z, the engagement claw 50*d* of the connector 50Z is engaged with the engagement recess 23*d* of the heater holder 23Z.

The embodiments of the present disclosure have been described as being applied to the fixing device 9 illustrated in FIG. 2, in which the fixing belt 20 serves as a fixing rotator and the pressure roller 21 serves as a pressure rotator. Alternatively, a fixing film, a fixing sleeve, or the like may be used as a fixing rotator. A pressure belt or the like may be used as a pressure rotator. The embodiments are also applicable to fixing devices illustrated in FIGS. 25 to 27, for example.

Figure 25:
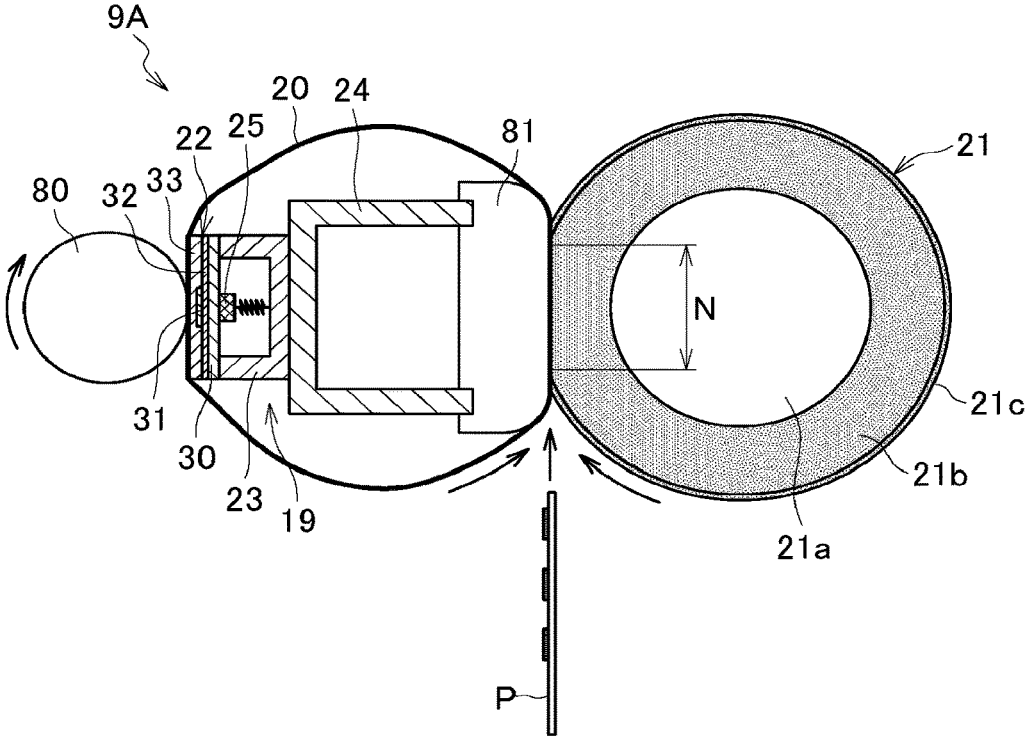
FIG. 25 is a schematic sectional view of a fixing device as a first variation of the fixing device of FIG. 2.
Figure 26:
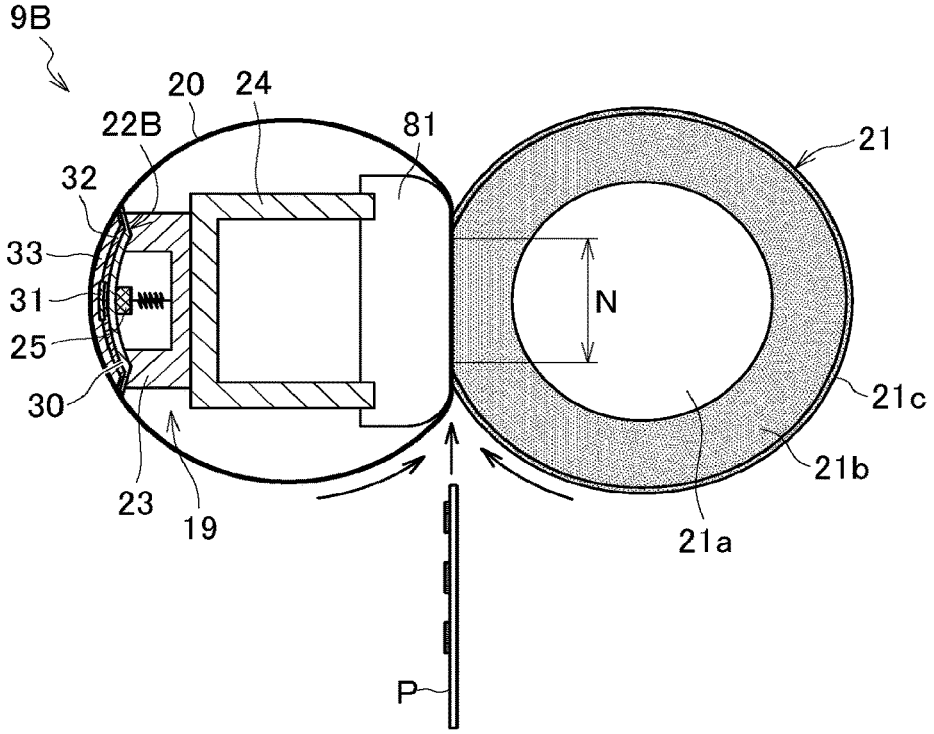
FIG. 26 is a schematic sectional view of a fixing device as a second variation of the fixing device of FIG. 2.
Figure 27:
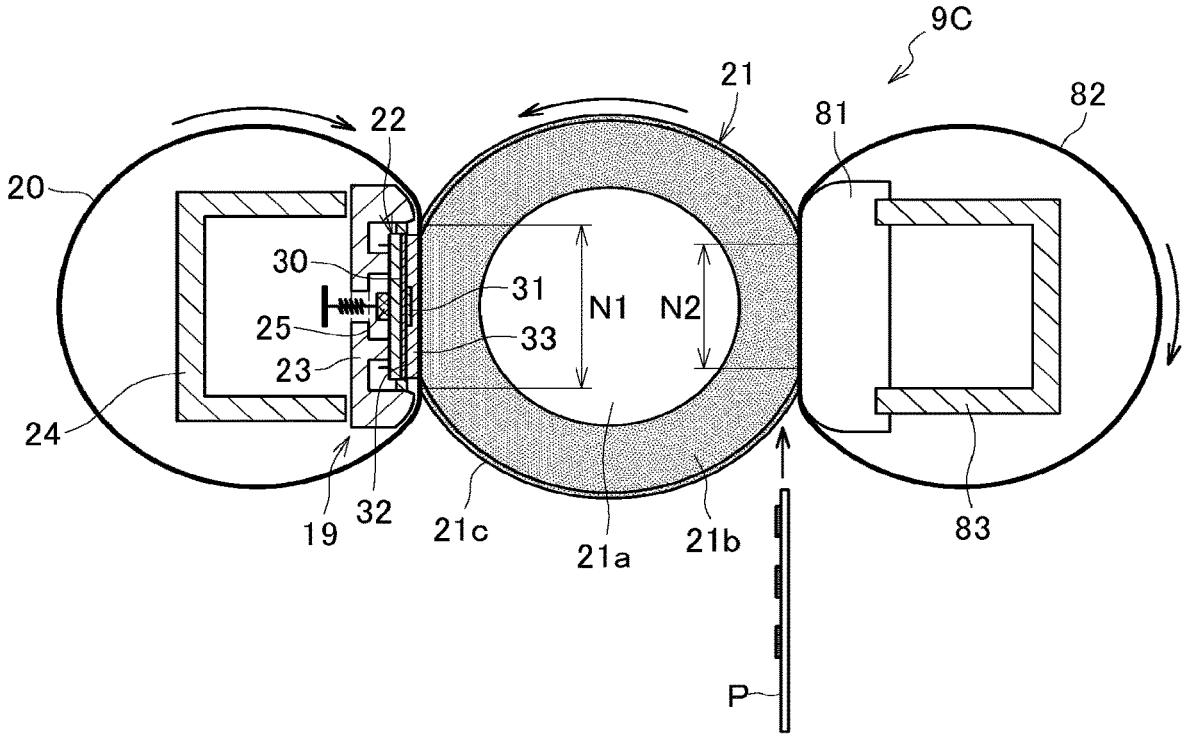
FIG. 27 is a schematic sectional view of a fixing device as a third variation of the fixing device of FIG. 2.

Referring now to FIGS. 25 to 27, a description is given of some variations of the fixing device 9.

Initially with reference to FIG. 25, a description is given of a configuration of a fixing device 9A as a first variation of the fixing device 9.

FIG. 25 is a schematic sectional view of the fixing device 9A.

As illustrated in FIG. 25, the fixing device 9A includes a pressure roller 80 as a second pressure roller. The pressure roller 21, as a first pressure roller, is disposed on one side of the fixing belt 20; whereas the pressure roller 80 is disposed across from the pressure roller 21. In short, the fixing belt 20 is interposed between the pressure rollers 21 and 80. The heater 22 sandwiches the fixing belt 20 together with the pressure roller 80, thereby heating the fixing belt 20. On a pressure roller 21 side, a nip formation pad 81 is disposed opposite the inner circumferential surface of the fixing belt 20. The nip formation pad 81 is supported by the stay 24. The nip formation pad 81 sandwiches the fixing belt 20 together with the pressure roller 21, thereby forming the fixing nip N.

Referring now to FIG. 26, a description is given of a configuration of a fixing device 9B as a second variation of the fixing device 9.

FIG. 26 is a schematic sectional view of the fixing device 9B.

As illustrated in FIG. 26, the fixing device 9B excludes the pressure roller 80 described above. On the other hand, the fixing device 9B includes a heater 22B that is formed in an arc shape conforming to the curvature of the fixing belt 20 so as to secure a circumferential contact length between the fixing belt 20 and the heater 22B. The rest of the configuration of the fixing device 9B is the same as the rest of the configuration of the fixing device 9A described above.

Referring now to FIG. 27, a description is given of a configuration of a fixing device 9C as a third variation of the fixing device 9.

FIG. 27 is a schematic sectional view of the fixing device 9C.

As illustrated in FIG. 27, the fixing device 9C includes a pressure belt 82 as a second belt, in addition to the fixing belt 20 as a first belt. The fixing belt 20 forms a heating nip N1, as a first nip, together with the pressure roller 21. On the other hand, the pressure belt 82 forms a fixing nip N2, as a second nip, together with the pressure roller 21. Specifically, the fixing belt 20 is disposed on one side of the pressure roller 21; whereas the nip formation pad 81 and a stay 83 are disposed across from the fixing belt 20. The pressure belt 82 is rotatable while encompassing the nip formation pad 81 and the stay 83. An image is fixed onto a sheet P under heat and pressure while the sheet P passes through the fixing nip N2 between the pressure belt 82 and the pressure roller 21. The rest of the configuration of the fixing device 9C is the same as the rest of the configuration of the fixing device 9 illustrated in FIG. 2.

The fixing devices 9A, 9B, and 9C are providable with the heating device 19 according to the embodiments described above. As described above, the heater 22 is energized when the connector 50 is attached to the heater holder 23. With the heating device 19 according to the embodiments of the present disclosure, the fixing devices 9A, 9B, and 9C facilitate the attachment of the connector 50 to the heater holder 23 while reliably engaging the connector 50 with the heater holder 23. As the connector 50 is engaged with the heater holder 23 near the contact position between the electrode 40 and the conduction terminal 42, the backlash between the electrode 40 and the conduction terminal 42 is restrained.

In the embodiments described above, the heater 22 is provided with the two electrodes 40. Alternatively, the heater 22 may be provided with three or more electrodes 40. In such a case, the engagement portion is disposed at an average position of the electrodes 40 (or a plurality of contact positions between the plurality of electrodes 40 and the plurality of conduction terminals 42) in a direction in which the electrodes 40 are aligned or arranged side by side. That is, the engagement portion is disposed near each contact position between the electrode 40 and the conduction terminal 42, thereby effectively restraining the backlash between the electrode 40 and the conduction terminal 42.

According to the embodiments described above, a holder and a connector serve as a guide pair to guide the connector in an attaching or mounting direction, which is a given direction to attach the connector to the holder. As a consequence, the connector is easily and reliably attached to the holder. Since the connector includes an engagement portion that is engaged with the holder, the backlash of the connector against the holder is restrained after the connector is attached to the holder.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

For example, the image forming apparatus according to the embodiments of the present disclosure is not limited to the color image forming apparatus 100 illustrated in FIG. 1. Alternatively, the image forming apparatus may be a monochrome image forming apparatus that forms a monochrome image on a recording medium. In addition, the image forming apparatus according to the embodiments of the present disclosure may be, e.g., a copier, a printer, a scanner, a facsimile machine, or a multifunction peripheral (MFP) having at least two of copying, printing, scanning, facsimile, and plotter functions.

Examples of the sheet P serving as a recording medium include plain paper, thick paper, a postcard, an envelope, thin paper, coated paper, art paper, tracing paper, an overhead projector (OHP) transparency, a plastic film, prepreg, and copper foil.

What is claimed is:

1. A heating device, comprising:

a heater including a base, a heat generating portion, and an electrode through which power is conducted;

a holder configured to hold the heater in a longitudinal direction along a first surface of the heater, wherein the electrode is formed on a second surface of the heater opposite the first surface;

a connector including a conduction terminal configured to contact the electrode; and an engagement portion configured to be engaged with the holder, the connector being attachable to the holder to engage the engagement portion with the holder and contact the conduction terminal with the electrode; and a guide pair including a convex portion disposed in one of the holder and the connector; and a recess disposed in another one of the holder and the connector, the guide pair configured to guide the connector in an attaching direction of the connector to attach the connector to the holder.

2. The heating device according to claim 1, wherein the engagement portion is disposed at a downstream end portion of the convex portion or the recess of the connector in the attaching direction of the connector.

3. The heating device according to claim 1, wherein the engagement portion is disposed opposite a contact position between the electrode and the conduction terminal.

4. The heating device according to claim 1, wherein the heater further includes a plurality of electrodes including the electrode, wherein the connector further includes a plurality of conduction terminals including the conduction terminal, and wherein the engagement portion is disposed at an average position of a plurality of contact positions between the plurality of electrodes and the plurality of conduction terminals in a direction in which the plurality of electrodes is aligned.

5. The heating device according to claim 1, wherein the guide pair is disposed opposite a contact position between the electrode and the conduction terminal.

6. The heating device according to claim 1,
wherein the connector is substantially U-shaped,
wherein the connector is configured to be attached to the holder while sandwiching the holder and the heater in a thickness direction of the holder, and
wherein the engagement portion is disposed on each of opposed sides of the connector in the thickness direction of the holder.

7. A fixing device comprising:
a fixing rotator; and
a heating device configured to heat the fixing rotator,
the heating device including
a heater including a base, a heat generating portion, and an electrode through which power is conducted;
a holder configured to hold the heater in a longitudinal direction along a first surface of the heater, wherein the electrode is formed on a second surface of the heater opposite the first surface;
a connector including
a conduction terminal configured to contact the electrode; and
an engagement portion configured to be engaged with the holder,
the connector being attachable to the holder to engage the engagement portion with the holder and contact the conduction terminal with the electrode; and
a guide pair including
a convex portion disposed in one of the holder and the connector; and
a recess disposed in another one of the holder and the connector,
the guide pair configured to guide the connector in an attaching direction of the connector to attach the connector to the holder.

8. An image forming apparatus comprising:
an image forming device configured to form a toner image; and
a fixing device configured to fix the toner image onto a recording medium,
the fixing device including
a fixing rotator; and
a heating device configured to heat the fixing rotator,
the heating device including
a heater including a base, a heat generating portion, and an electrode through which power is conducted;
a holder configured to hold the heater in a longitudinal direction along a first surface of the heater, wherein the electrode is formed on a second surface of the heater opposite the first surface;
a connector including
a conduction terminal configured to contact the electrode; and
an engagement portion configured to be engaged with the holder,
the connector being attachable to the holder to engage the engagement portion with the holder and contact the conduction terminal with the electrode; and
a guide pair including
a convex portion disposed in one of the holder and the connector; and
a recess disposed in another one of the holder and the connector,
the guide pair configured to guide the connector in an attaching direction of the connector to attach the connector to the holder.

9. The heating device of claim 1, wherein the holder holds the heater along a longitudinal direction of the heater, including at a center of the heater in the longitudinal direction of the heater.

10. The heating device of claim 1, wherein the heater includes an insulating layer formed on the base, and
the electrode is formed on the insulating layer.

11. The heating device of claim 4, wherein the connector contacts the heater only at the electrodes.

* * * * *